United States Patent [19]

Yukumoto et al.

[11] Patent Number: 4,754,804

[45] Date of Patent: Jul. 5, 1988

[54] METHOD AND APPARATUS FOR PRODUCING RAPIDLY SOLIDIFIED METALLIC TAPES

[75] Inventors: Masao Yukumoto; Michiharu Ozawa, both of Chiba, Japan

[73] Assignee: Kawasaki Steel Corporation, Kobe, Japan

[21] Appl. No.: 108,212

[22] Filed: Oct. 13, 1987

[30] Foreign Application Priority Data

Oct. 17, 1986 [JP] Japan ..... 61-245598

[51] Int. Cl.[4] ..... B22D 11/06

[52] U.S. Cl. ..... 164/463; 164/480; 164/423; 164/428

[58] Field of Search ..... 164/463, 423, 428, 480

[56] References Cited

U.S. PATENT DOCUMENTS 4,546,814 10/1985 Shibuya et al. ..... 164/480

4,565,240 1/1986 Shibuya et al. ..... 164/480

*Primary Examiner*—Kuang Y. Lin

*Attorney, Agent, or Firm*—Balogh, Osann, Kramer, Dvorak, Genova & Traub

[57] ABSTRACT

A rapidly solidified metallic tape is produced by continuously pouring molten metal into a casting space defined among a pair of cooling members and a pair of keep members each disposed close to side edge faces of the cooling rolls to rapidly solidify it. In this method, a solidification shell of molten metal produced on the keep member is continuously moved in a direction opposite to the pouring direction to eliminate to exterior from the system. In the apparatus for practicing the method, the keep member comprises a fixed side plate, a side roll rotatably arranged along a guide groove formed in the central and lower portion of the side plate, a driving means for the rotation of the side roll in a direction opposite to the pouring direction and a means for removing solidification shell from the surface of the side plate.

7 Claims, 5 Drawing Sheets

METHOD AND APPARATUS FOR PRODUCING RAPIDLY SOLIDIFIED METALLIC TAPES

BACKGROUND OF THE INVENTION

1. Field of the Invention

This invention relates to a method and an apparatus for producing a rapidly solidified metallic tape, and more particularly to an improvement in the shape, particularly side edge shape of the metallic tape obtained through twin-roll process while stably maintaining continuous operation.

2. Related Art Statement

As a production method of the metallic tape, the twin-roll process as shown in FIG. 2 is developed and put into practical use. In the twin-roll process, molten metal 1 is continuously supplied from a pouring nozzle 2 to a kissing region between a pair of cooling rolls 3, 3 rotating at a higher speed to form a rapidly solidified metallic tape 4.

However, the metallic tape produced by the twin-roll process generally has a crown shape, wherein the central portion is thick and both side edge portions are thin. Further, the saw-tooth shape or the oxidized area is formed in both the side edge portions. In order to obtain a sound product, therefore, it is obliged to cut away both the side edge portions from the resulting tape, resulting in the reduction of yield.

This is considered due to the fact that excessive molten metal periodically flows in the axial direction of the roll owing to the unbalance between pouring rate and solidification rate and the molten metal height is lower at the vicinity of both side edge portions of the roll than at the central portion thereof, and consequently heat crown is caused to produce solidification cracks in both side edge portions of the tape and the break-out is caused or the oxidized area is formed.

In order to solve these problems, therefore, there have hitherto been proposed many methods for holding molten metal at the kissing region between rolls. Among these methods, there is a typical method as shown in FIGS. 3*a* and 3*b*, wherein molten metal 1 is poured into a space defined by two cooling rolls 3, 3 and two fixed stoppers (side plates) 5 pushed to the side faces of the rolls to continuously produce a metallic tape 4. In the latter method, however, molten metal is cooled by atmosphere or by the side plates, so that the adhesion of solidified or semi-solidified shell to the side plate increases, and finally such a shell falls off from the side plate into the space between rolls and is entrapped in the cast tape to produce discontinuous part therein, which causes operation troubles such as tape cutting, roll stop or roll deformation based on the occurrence of abnormal reaction force to the reduction, and the like.

In Japanese patent laid open No. 57-130,743 is proposed a method, wherein an end keep 5 provided with a porous refractory 6 is pushed to the side edge of the roll 3 to thereby prevent the leakage of molten metal 1 and at the same time an inert gas 7 is supplied through the porous refractory 6 to prevent the formation of solidification shell based on the cooling of molten metal as shown in FIG. 4. In this method, however, it is very difficult to uniformly supply the inert gas over the whole of the side edge face of the roll, so that the formation and adhesion of solidification shell to the side edge face of the roll can not completely be prevented. For this end, once the solidification shell is adhered to the side edge face, the growth of the shell can not be prevented by this method. As a result, the abrading is promoted by the long-period use to cause the thrusting of molten metal into the resulting gap between the side edge face of the roll and the end keep, so that the continuous pouring is still impossible.

In Japanese patent laid open No. 60-234,744 is proposed an apparatus wherein the end keep is replaced with a caterpillar- or belt-type movable side seal 8 and a fixed side plate 5 is pushed to the movable side seal 8 for improving the adhesion property to the side edge face of the cooling roll 3 as shown in FIGS. 5*a* and 5*b*.

In this apparatus, the metallic tape is produced by moving the movable side seal in the same direction as the pouring direction of molten metal or the travelling direction of the tape to reduce the adhesion of solidification product to the side seal.

Although the leakage of molten metal from the side edge face of the roll is fairly prevented in the above apparatus, if the solidification product is slightly formed on the side seal, it is squeezed between the rolls to form a gripped portion in the cast tape at the kissing region. Particularly, in case of tapes having a thinner thickness, the above gripped portion largely affects the properties of the side edge portion of the tape, resulting in the occurrence of break-out.

In Japanese patent laid open No. 58-212,845 is proposed an apparatus for preventing the break-out of the tape, wherein a part of the side plate is replaced with a movable water-cooled roll 9 to produce the solidification product in the side edge portion of the roll as shown in FIGS. 6*a* and 6*b*. In this apparatus, however, there are caused the same problems as in the aforementioned Japanese patent laid open No. 60-234,744.

In any case, the adhesion of solidification product to the side plate can not be avoided according to the conventional techniques, so that the properties of the side edge face of the tape are apt to be degraded and the break-out is apt to be caused, and hence the continuous pouring becomes difficult industrially.

SUMMARY OF THE INVENTION

It is, therefore, an object of the invention to provide a method and an apparatus for producing rapidly solidified metallic tapes which can effectively prevent the degradation of properties at the side edge portion of the tape and the occurrence of break-out resulted from the member supporting the side edge face of the tape as problems of the aforementioned conventional techniques.

The inventors have made close investigations with respect to the conventional techniques for the production of rapidly solidified metallic tapes, and confirmed that in the conventional methods wherein the side edge face of the tape at the space between the rolls is sealed by the keep member for the side edge face, even when such a member is a circulation moving type, if the surface of the member facing molten metal is not heated and held up to a temperature near the melting point of molten metal to be cast, the formation of solidification shell of molten metal onto the surface of the keep member can not be prevented. Particularly, when molten metal to be cast is a high-melting metal such as iron alloy or the like, it is actually impossible to heat the keep member up to a temperature corresponding to such a melting point, so that the formation of solidification shell onto the surface of the keep member facing molten metal is unavoidable.

That is, when the solidification shell is formed on the surface of the keep member, it is squeezed into the space between the rolls to form a gripped portion at the narrowest space between the rolls, which results in the degradation of properties at the side edge portion of the resulting tape and hence the occurrence of breakout.

From the above viewpoints, the inventors have had confidence that even when the solidification shell is formed on the keep member, if such a shell is removed so as not to arrive at the narrowest space between the rolls, the above problems can effectively be solved. In this connection, the inventors have made further studies based on a new technical idea completely different from the aforementioned conventional technical ideas, and as a result the invention has been accomplished.

According to a first aspect of the invention, there is the provision of a method for producing a rapidly solidified metallic tape by continuously pouring molten metal into a casting space defined among a pair of cooling rolls and a pair of keep members each disposed close to side edge faces of these cooling rolls to rapidly solidify it, characterized in that a solidification shell of molten metal produced on the surface of the keep member is continuously moved in a direction opposite to a pouring direction of molten metal to eliminate from the casting space to exterior.

According to a second aspect of the invention, there is the provision of an apparatus for producing a rapidly solidified metallic tape, comprising a pair of cooling rolls and a pair of keep members each disposed close to side edge faces of these cooling rolls to define a casting space, and a pouring nozzle for supplying molten metal to the casting space, characterized in that said keep member comprises a fixed side plate, a side roll rotatably arranged along a guide groove formed in a central and lower portion of the side plate, a driving means for rotating the side roll in a direction opposite to a pouring direction of molten metal and a means for removing a solidification shell of molten metal produced on and adhered to the surface of the side roll.

BRIEF DESCRIPTION OF THE DRAWINGS

The invention will be described with reference to the accompanying drawings, wherein.

DESCRIPTION OF THE PREFERRED EMBODIMENTS

Figure 1A:
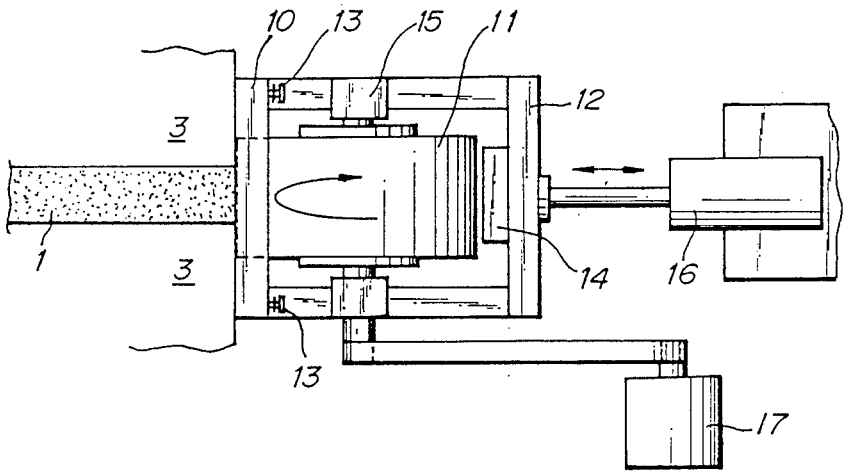
FIGS. 1*a* and 1*b* are plan and elevational views of a preferred embodiment of the apparatus for producing rapidly solidified metallic tapes according to the invention, respectively.
Figure 1B:
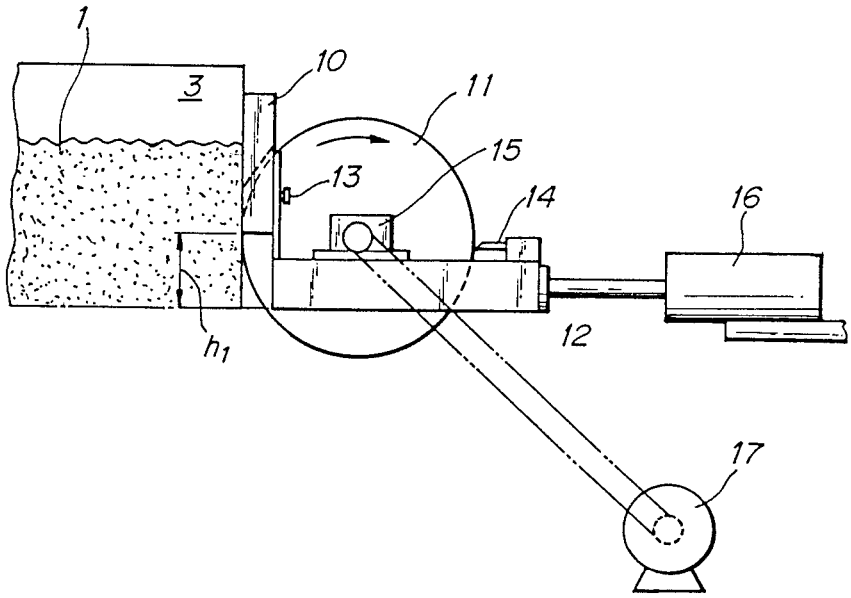

FIGS. 1*a* and 1*b* show a preferred embodiment of the apparatus for producing a rapidly solidified metallic tape according to the invention. Moreover, only the right-side half of the apparatus is shown in FIGS. 1*a* and 1*b* because the apparatus is bisymmetrical.

In FIGS. 1*a* and 1*b*, numeral 10 is a fixed side plate, numeral 11 a rotatable side roll, and numeral 12 a support base for the side roll 11. On the support base 12 are further arranged a slightly adjusting spring 13 for the side plate 10 and a means 14 for removing a solidification shell of molten metal such as a scraper or the like. Moreover, numeral 15 is a bearing, numeral 16 a cylinder and numeral 17 a motor.

The side plate 10 is pushed to one side edge faces of cooling rolls 3, 3 by the action of the cylinder 16. In this case, the pushing force of the side plate 10 to the side edge face of the cooling roll 3 is finally adjusted by the slightly adjusting spring 13 so as to make a gap between the side plate and the side edge face of the cooling roll to zero, whereby the leakage of molten metal from the side plate face is prevented, and hence the formation of the solidification shell at the side edge face of the cooling roll is prevented. Further, a guide groove is formed in the central and lower portion of the side plate 10, along which the side roll 11 is rotatably driven by the motor 17 through the bearing 15 in a direction opposite to the pouring direction of molten metal.

Moreover, even when the solidification shell of molten metal is produced on the surface of the side plate 10, it gradually descends toward the rotating side roll 11 during the formation of a cast tape and adheres to the surface of the side roll 11. Such an adhered shell is led from the inside of the system to the outside thereof with the rotation of the side roll 11 and removed from the surface of the side roll 11 by means of the scraper 14 located at a position opposite to a kissing point between the side roll and the cast tape by 180 degrees.

According to the invention, it is important that the side roll is arranged so that the center of the side roll is higher by a height $h_1$ than a kissing point between the cooling rolls. Because, when the center of the side roll is the same level as the kissing point between the cooling rolls, there is a great risk that the semi-solidified shell adhered to the side roll falls down into the space between the cooling rolls to be caught in the cast tape before the discharge to the outside.

Moreover, the leakage of molten metal can be prevented by setting the height $h_1$ to not more than a half of a maximum molten metal height $h_{max}$ measured from the kissing point between the cooling rolls as shown in FIG. *7a*.

In this way, the solidification shell formed on the fixed side plate 10 can be discharged to the outside of the system at an initial stage.

In FIGS. *7a* and *7b* is shown an appropriate relation in the arrangement between the fixed side plate 10 and the side roll 11.

As shown in FIGS. *7a* and *7b*, the outer diameter D of the side roll 11 is desirable to satisfy the condition of $$D \geqq H + \frac{(h_{max} - h_1)^2}{H},$$

preferably $$D \geqq H + \frac{(h_2 - h_1)^2}{H},$$

wherein H is a thickness of the fixed side plate $h_{max}$ is a maximum molten metal height measured from the kissing point between the cooling rolls, $h_2$ is a distance from the kissing point to a top of the fixed side plate ($h_2 \geqq h_{max}$), and $h_1$ is a distance from the kissing point to the center of the side roll ($h_1 \leqq h_{max} \times \frac{1}{2}$).

When D is small in the above condition, the leakage of molten metal is caused from a gap between the side plate and the side roll, while the preferable condition more guarantees the prevention of molten metal leakage.

Figure 7A:
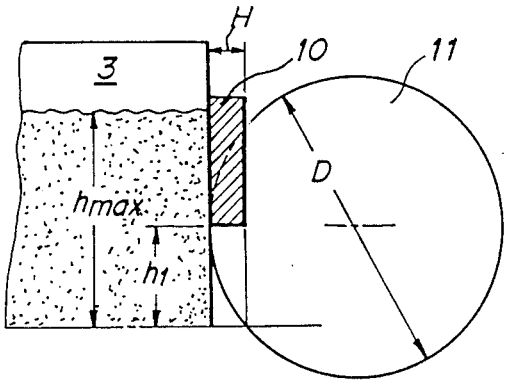
FIGS. 7*a* and 7*b* are schematic views for calculating preferable diameter of side roll and width of fixed side plate, respectively.
Figure 7B:
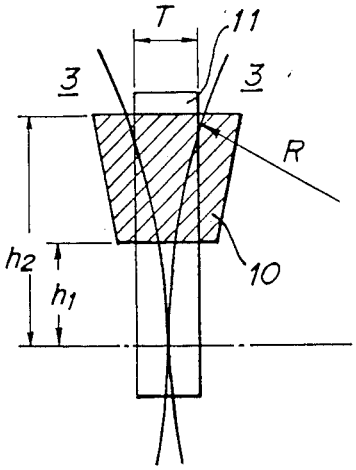

The width T of the side roll shown in FIG. 7*b* is given by an equation of $T=2(R-\sqrt{R^2-h_2^2})$, wherein R is a radius of the cooling roll.

Moreover, when the solidification shell to be discharged through the side roll 11 becomes extremely thick, it is difficult to stably discharge the shell through the side roll and the yield of cast tape unfavorably lowers. Therefore, it is desirable that the side roll is made from a material having a thermal conductivity lower than that of the cooling roll 3.

The invention will be described with reference to the following example.

EXAMPLE

A metallic tape was produced by using a twin-roll type apparatus for the production of rapidly solidified metallic tapes shown in FIG. 1 under the following production conditions. That is, molten alloy of 5.5% Si-Fe composition was continuously poured into a kissing region between a pair of cooling rolls 3, 3, each being an internal water-cooled type roll provided with a roll sleeve of a copper alloy of 550 mm in outer diameter and 500 mm in length and rotating at a peripheral speed of 5 m/sec under a reduction force of 1 ton, at a pouring rate of 6 kg/sec to form a rapidly solidified alloy tape. In this case, the side plate 10 and the side roll 11, each being made from fused silica, BN, $Si_3N_4$ and graphite, were disposed close to the side edge faces of the cooling rolls 3, 3. The side roll 11 was rotated at a peripheral speed of 3 m/sec in a direction opposite to the pouring direction of molten alloy. Moreover, the outer diameter of the side roll 11 was 100 mm, and the thickness of the side plate 10 was 10 mm.

As a result of the experiment, the leakage of molten alloy and the break-out due to the formation of solidification shell were not caused even in the pouring of 2 tons per heat cycle.

Figure 8A:
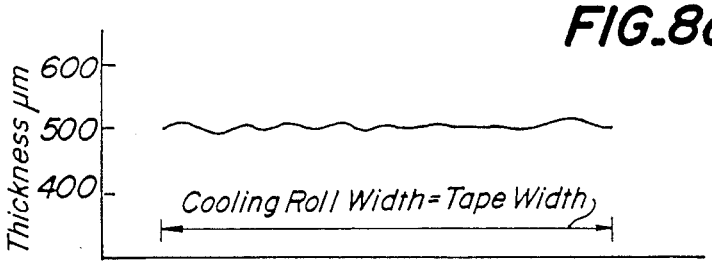
FIGS. 8*a*, 8*b* and 8*c* are graphs showing widthwise sectional shapes of rapidly solidified metallic tapes produced according to the invention and the conventional technique, respectively.

The shape of the resulting alloy tape is shown in FIG. 8*a*, from which it is understood that the tape width extends over a whole width of the cooling roll and the distribution of the tape thickness is smooth and has a deviation of ±3%.

Figure 2:
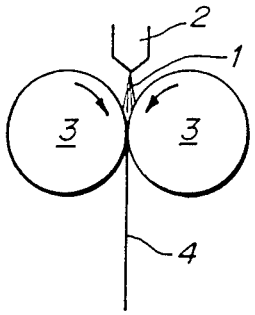
FIG. 2 PRIOR ART
FIG. 2 is a diagrammatical view of the conventional twin-roll apparatus having no keep member for side edge face of roll.
Figure 8B:
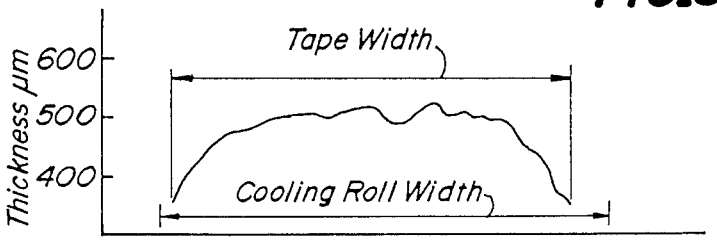

On the contrary, when the metallic tape was produced by using the apparatus shown in FIG. 2, the thickness distribution of the tape is thick in the central portion and thin in both side edge portions and has a saw-tooth shape, and the tape width does not extend over the width of the cooling roll as shown in FIG. 8*b*.

Figure 3A:
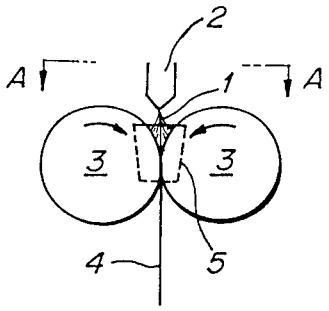
FIG. 3a PRIOR ART
FIGS. 3*a* and 3*b* are side and plan views of the conventional twin-roll apparatus provided with a keep member for side edge face of roll, respectively.
Figure 3B:
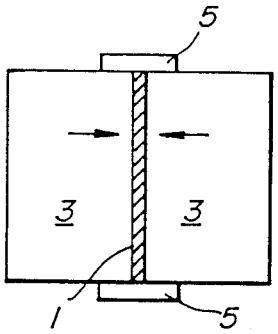
FIG. 3b PRIOR ART
Figure 4:
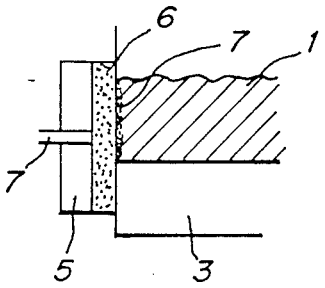
FIG. 4 PRIOR ART
FIG. 4 is a partially diagrammatical view of the conventional twin-roll apparatus provided with a keep member made from a porous material.
Figure 5A:
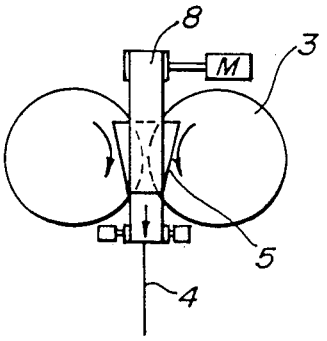
FIG. 5a PRIOR ART
FIGS. 5*a* and 5*b* are elevational and side views of the conventional twin-roll apparatus provided with a belt-type movable belt, respectively.
Figure 5B:
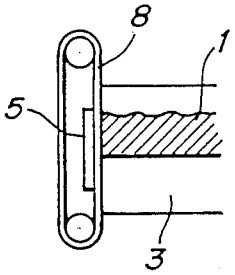
FIG. 5b PRIOR ART
Figure 6A:
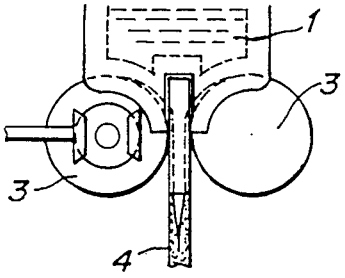
FIG. 6a PRIOR ART
FIGS. 6*a* and 6*b* are side and elevational views of the conventional twin-roll apparatus provided with a movable cooling roll, respectively.
Figure 6B:
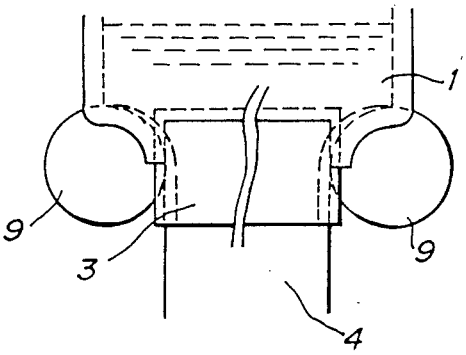
FIG. 6b PRIOR ART
Figure 8C:
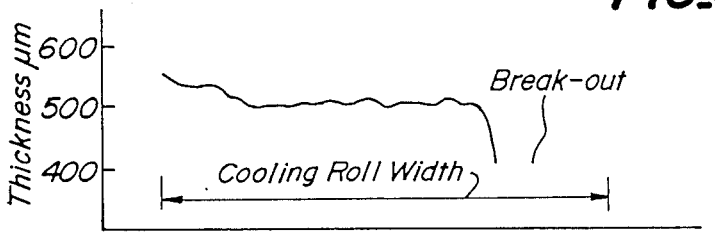

Furthermore, when the metallic tape was produced by using the apparatus shown in FIGS. 3*a* and 3*b*, molten metal leaked in the pouring of about 200 kg, and the break-out was caused due to the growth of solidification shell (FIG. 8*c*).

Figures 9A, 9B, 9C:
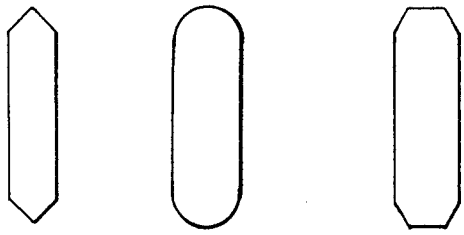
FIGS. 9*a*, 9*b* and 9*c* are diagrammatic views illustrating another preferred shapes of side plate according to the invention, respectively.

The side roll 11 according to the invention is not limited to the shape shown in FIG. 7, and may take a shape as shown in FIGS. 9*a*~9*c*.

As mentioned above, according to the invention, when the rapidly solidified metallic tape is produced by the twin-roll process, the occurrence and growth of molten metal leakage and solidification shell can effectively be prevented without damaging the side edge face of the cooling roll, and the continuous operation can be realized over a long period. Further, there can easily be obtained metallic tapes having excellent shape and quality with a thickness deviation of not more than 3%.

What is claimed is:

1. A method for producing a rapidly solidified metallic tape by continuously pouring molten metal into a casting space defined among a pair of cooling rolls and a pair of keep members each disposed close to side edge faces of said cooling rolls to rapidly solidify it, characterized by continuously moved a solidification shell of molten metal produced on the surface of said keep member in a direction opposite to a pouring direction of molten metal to remove said shell from said casting space to exterior thereof.

2. An apparatus for producing a rapidly solidified metallic tape, comprising a pair of cooling rolls and a pair of keep members each disposed close to side edge faces of said cooling rolls to define a casting space, and a pouring nozzle for supplying molten metal to said casting space, characterized in that said keep member comprises a fixed side plate, a side roll rotatably arranged along a guide groove formed in a central and lower portion of said side plate, a driving means for rotating said side roll in a direction opposite to a pouring direction of molten metal and a means for removing a solidification shell of molten metal produced on and adhered to the surface of said side roll.

3. The apparatus according to claim 2, wherein said side roll is arranged so that a center of said side roll locates at a height $h_1$ higher than a kissing point level between said cooling rolls.

4. The apparatus according to claim 3, wherein said height $h_1$ is set to not more than a half of a maximum molten metal height $h_{max}$ measured from said kissing point level.

5. The apparatus according to claim 2, wherein said side roll has a diameter D satisfying the following relation;

$$D \geqq H + \frac{(h_{max} - h_1)^2}{H}$$

wherein H is a thickness of the fixed side plate, $h_{max}$ is a maximum molten metal height measured from a kissing point level between the cooling rolls and $h_1$ is a distance from the kissing point level to a center of the side roll.

6. The apparatus according to claim 2, wherein said side roll has a width T satisfying the following relation:

$$T=2(R-\sqrt{R^2-h_2^2}),$$

wherein R is a radius of the cooling roll and $h_2$ is a distance from a kissing point level between the cooling rolls to a top of the fixed side plate.

7. The apparatus according to claim 2, wherein said side roll is made from a material having a thermal conductivity lower than that of said cooling roll.

* * * * *